US010220645B2

(12) United States Patent
Gupta

(10) Patent No.: US 10,220,645 B2
(45) Date of Patent: Mar. 5, 2019

(54) QUICK STENCIL KIT

(71) Applicant: Nikhil Gupta, Schaumburg, IL (US)

(72) Inventor: Nikhil Gupta, Schaumburg, IL (US)

( * ) Notice: Subject to any disclaimer, the term of this patent is extended or adjusted under 35 U.S.C. 154(b) by 0 days.

(21) Appl. No.: 15/982,801

(22) Filed: May 17, 2018

(65) Prior Publication Data

US 2018/0333976 A1 Nov. 22, 2018

Related U.S. Application Data

(60) Provisional application No. 62/507,562, filed on May 17, 2017.

(51) Int. Cl.

| | |
|---|---|
| ***B65D 71/00*** | (2006.01) |
| ***B41N 1/24*** | (2006.01) |
| ***B65C 5/02*** | (2006.01) |
| ***B65C 11/02*** | (2006.01) |
| ***B41L 13/02*** | (2006.01) |
| *B44D 2/00* | (2006.01) |

(52) U.S. Cl.

CPC ..... *B41N 1/248* (2013.01); *B41L 13/02* (2013.01); *B65C 5/02* (2013.01); *B65C 11/02* (2013.01); *B44D 2/002* (2013.01); *B44D 2/007* (2013.01)

(58) Field of Classification Search

CPC ..... B41L 13/02; B41N 1/248; B65C 5/02; B65C 11/02; B44D 2/002; B44D 2/007

USPC ..... 206/214, 223, 224, 225, 38, 564, 575, 206/579; 434/81, 87

See application file for complete search history.

(56) References Cited

U.S. PATENT DOCUMENTS

| | | | | | |
|---|---|---|---|---|---|
| 3,840,113 | A * | 10/1974 | Bartleson | B44D 2/002 | 206/1.7 |
| 4,018,332 | A * | 4/1977 | Benda | B44C 5/04 | 206/223 |
| 4,604,062 | A * | 8/1986 | Woods | G09B 11/10 | 434/259 |
| 4,836,783 | A * | 6/1989 | Harper | A63H 33/22 | 226/129 |
| 4,989,734 | A * | 2/1991 | Mode | A47F 13/00 | 206/225 |
| 5,100,324 | A * | 3/1992 | Slayton | A45C 11/36 | 101/127.1 |

(Continued)

*Primary Examiner* — Luan K Bui

(74) *Attorney, Agent, or Firm* — Robert S. Alexander; Ferrells, PLLC; Anna L. Kinney

(57) ABSTRACT

A kit for creating stencils is provided, including a polymeric shell, multiple linear polymeric frames, multiple thermoplastic rubber polymeric alphanumeric stencil elements, a rolling ball marker, and a roll of markable web. The polymeric shell has a tray and a hingedly joined sealing top. The tray is generally rectangular with a peripheral sidewall and has a storage compartment each for the web roll, the stencil elements, the frames, and the marker. The sidewall adjacent the web roll compartment has an opening therethrough. The frames have an elongate central planar portion and a pair of parallel upraised crenellated sidewalls with stencil retention elements defined in the crenels. The frames also have mateable elements defined at each end to join the frames together. The stencil elements fit between the frame sidewalls and have elongate projections with stencil retention elements adapted to mate with the stencil retention elements defined in the frame crenels.

11 Claims, 16 Drawing Sheets

(56) References Cited

U.S. PATENT DOCUMENTS

| | | | | | |
|---|---|---|---|---|---|
| 5,203,706 | A * | 4/1993 | Zamir | G09B 1/16 | 434/159 |
| 5,595,302 | A * | 1/1997 | Maydwell | A45C 3/02 | 190/109 |
| 2006/0078855 | A1 * | 4/2006 | Thomas | G09B 11/00 | 434/81 |

* cited by examiner

FIG. 1
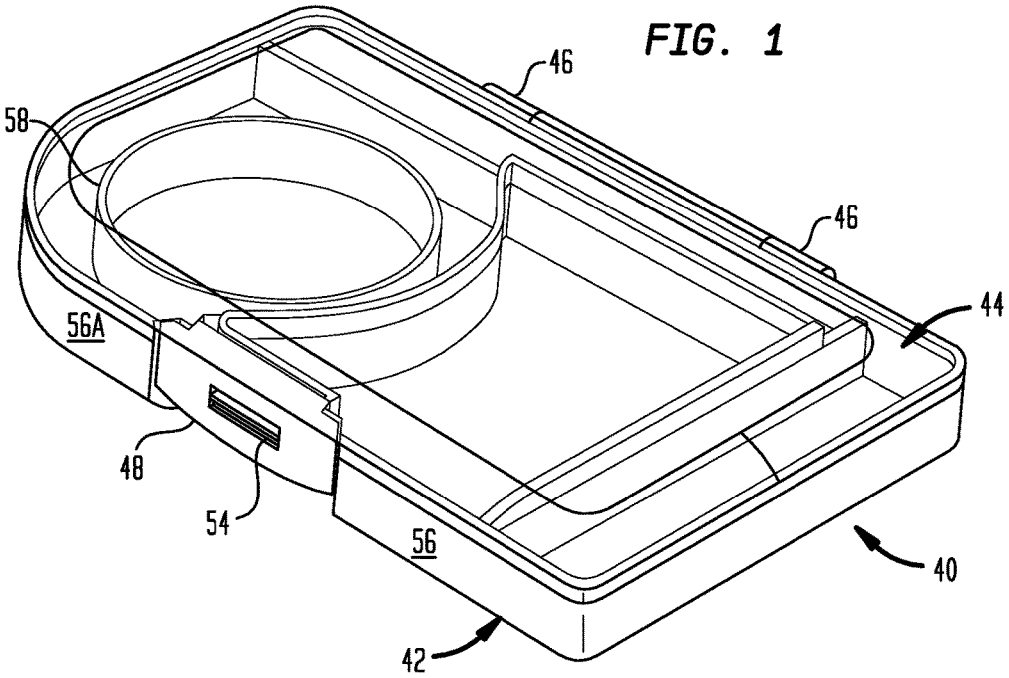
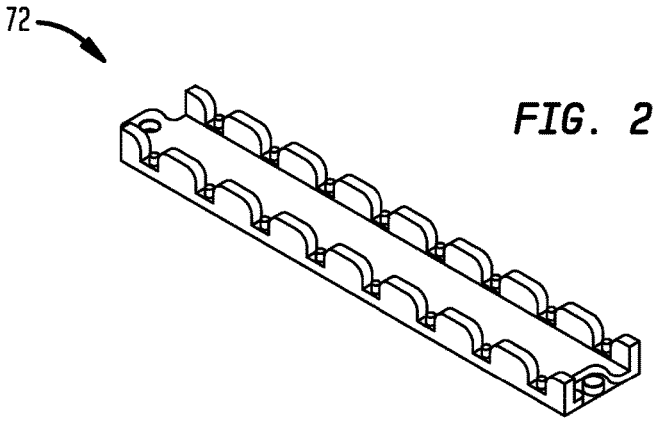
FIG. 2
FIG. 3
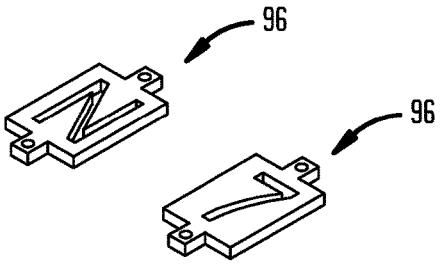

QUICK STENCIL KIT

CLAIM FOR PRIORITY

This Non-Provisional patent application is based on U.S. Provisional Patent Application Ser. No. 62/507,562, filed on May 17, 2017, the priority of which is claimed, and the disclosure of which is incorporated herein by reference.

BACKGROUND OF THE INVENTION

As America ages, more and more citizens are opting for retirement communities and/or assisted living facilities of various kinds even while retaining substantial vitality and ability to care for themselves as these facilities can free them from some of the more mundane aspects of life such as cooking for oneself, mowing the lawn, exterior maintenance and laundry. However in many facilities, laundry will be co-mingled to achieve economies of processing and so some kind of marking will be required for each item to indicate ownership and facilitate return thereof to the owner. However, marking personal property to indicate the identity of the owner is frequently necessary but rarely convenient, particularly when it is desired to mark items of clothing which may be laundered with clothing belonging to others but then must be separated and returned to each item's owner. This invention relates to a kit which combines all of the items needed to rapidly create multiple labels which can be applied to items of clothing for identification purposes using a process which is easily mastered, easily repeatable, results in high legibility markings and, once set up, can be reused later without additional setup.

SUMMARY OF THE INVENTION

This invention relates to a compact, easily stored, kit for creating stencils, comprising: a polymeric shell comprising a tray and a sealing top movably attached to said tray, preferably by hinges; said tray being generally rectangular with a peripheral sidewall and having a plurality of compartments defined therein, wherein said tray is comprised of a styrenic polymer; said sealing top is hingedly joined to said tray and is chosen from the group consisting of transparent and translucent polymers; and wherein said tray includes at least: a roll storage compartment having an opening defined through said peripheral sidewall; wherein a portion of the peripheral sidewall adjacent said roll storage compartment and having an opening therethrough is generally arcuate having a radius of curvature of at least 25% of the width of said tray; a letter element storage compartment; a frame holder compartment; and a marker holding compartment; a linear polymeric frame comprised of an acrylonitrile butadiene styrene polymer having: an elongate central planar portion; a pair of parallel upraised sidewalls spaced on either side of said elongate central planar portion; a plurality of stencil retention elements defined in each said sidewall, spaced along the length thereof; a plurality of thermoplastic rubber polymeric alphanumeric stencil elements comprised of an injection moldable thermoplastic rubber polymer adapted to fit between said upraised sidewalls and mate with said stencil retention elements defined therein; a rolling ball marker dispensing an ink resistant to laundering; a roll of markable web having an adhesive backing adapted to be retained within said roll storage compartment, wherein said markable web is comprised of a textile material and said adhesive backing is an iron-on adhesive, the width of said web being adapted to pass through said opening defined through said peripheral sidewall of said roll storage compartment, and adapted to longitudinally pass between said upraised sidewalls of said linear frame yet be laterally restrained thereby. The alphanumeric stencil elements are maintained in position by a combination of posts defined in one of said frame and said stencil elements mating with apertures in the other of said frame and said stencil elements, the posts and apertures being arranged such that when said alphanumeric stencil elements are in place, the lower surface of the elements is spaced from the central planar portion of the frame such that the markable web may be passed thereunder. To ensure that the stencil kit remains compact, one end of each frame is fitted with a post while the other is fitted with a mating aperture so that several elements may be joined together if necessary to spell out longer names or other indicia of identification.

Other aspects and advantages of the present invention are described in the detailed description below and in the claims.

BRIEF DESCRIPTION OF THE DRAWINGS

The invention is described in detail below with reference to the appended drawings, wherein like numerals designate similar parts. In the Figures:

FIG. 1 is a perspective view which illustrates a combination dispenser/carrying case/storage case for the quick stencil kit present invention having a plurality of compartments defined therein.

FIG. 2 is a perspective view which illustrates a combination labeling/stencil retention frame having a longitudinally extending central channel adapted to guide a labeling web underneath alphanumeric stencils held in place by peripheral longitudinally spaced mating retainers adapted to retain a labeling web underneath interchangeable stencil elements.

FIG. 3 is a perspective view which illustrates two representative alphanumeric stencil elements adapted to be held in place by the spaced mating retainers of the combination labeling/stencil holding frame of FIG. 2.

FIGS. 13 through 15 are respectively top, rear elevation and bottom views of the lid of the combination dispenser/carrying case/storage case of the present invention while

FIGS. 18 through 20 are respectively top, rear elevation and bottom views of the base tray of the combination dispenser/carrying case/storage case of the present invention while

FIGS. 23 through 25 are respectively rear, top elevation and front views of the latch of the combination dispenser/carrying case/storage case of the present invention while

FIGS. 28 through 30 are respectively top, rear elevation and bottom views of a retaining frame used in the practice of the present invention while

DESCRIPTION OF PREFERRED EMBODIMENT

The invention is described in detail below with reference to a preferred embodiment. Such discussion is for purposes of illustration only. Modifications to particular examples within the spirit and scope of the present invention, set forth in the appended claims, will be readily apparent to one of skill in the art. Terminology used herein is given its ordinary meaning consistent with the exemplary definitions set forth immediately below.

Figure 8:
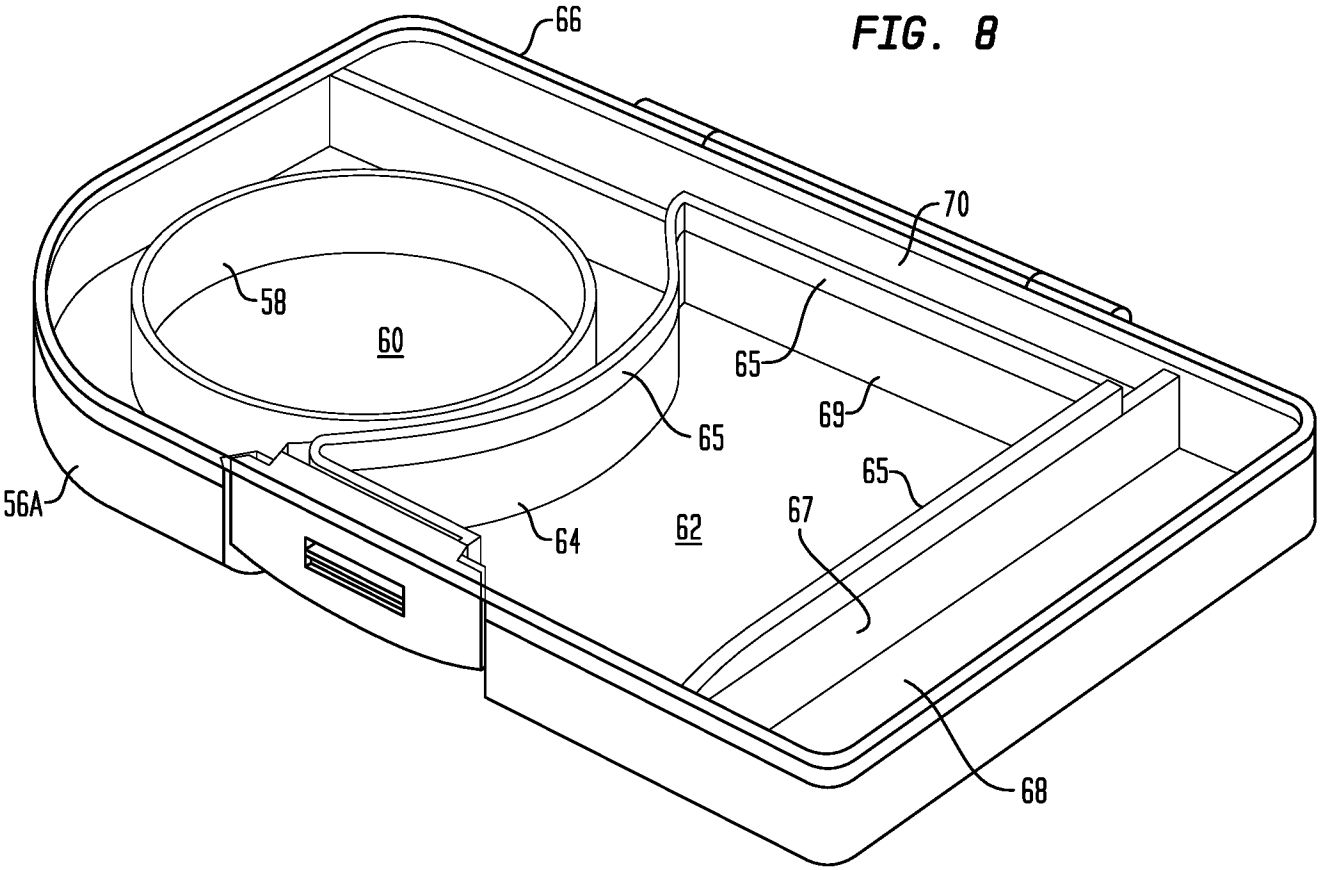
FIG. 8 is an enlarged perspective view of the combination dispenser/carrying case/storage case of FIG. 1 wherein the various compartments are visible through the translucent lid of the case.
Figure 18:
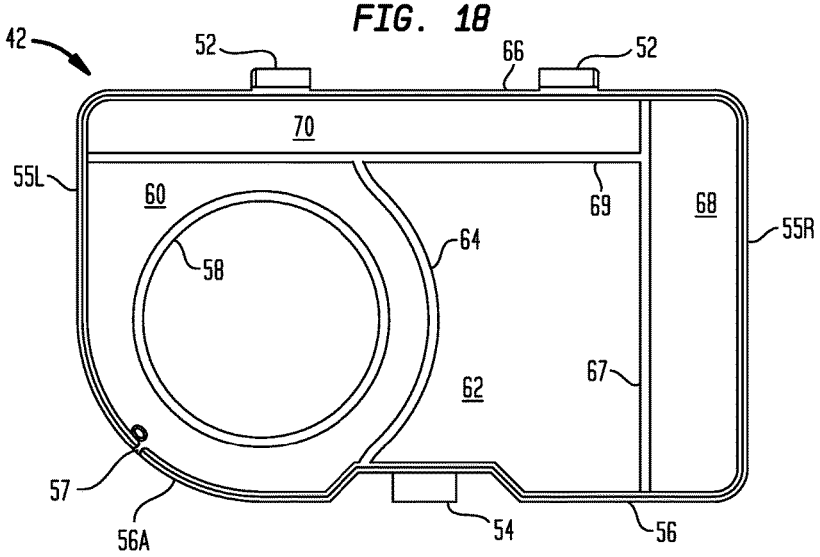
Figure 19:
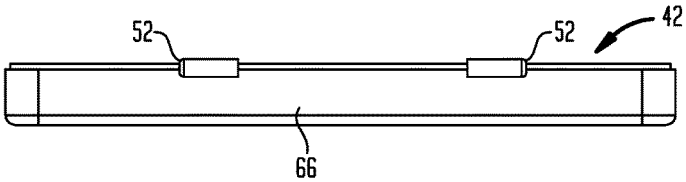
Figure 21:
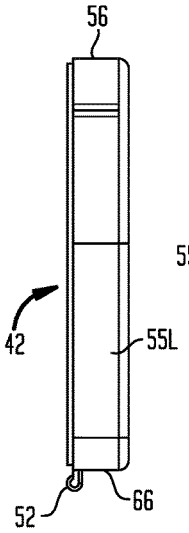
FIG. 21 is a side elevation thereof.
Figure 20:
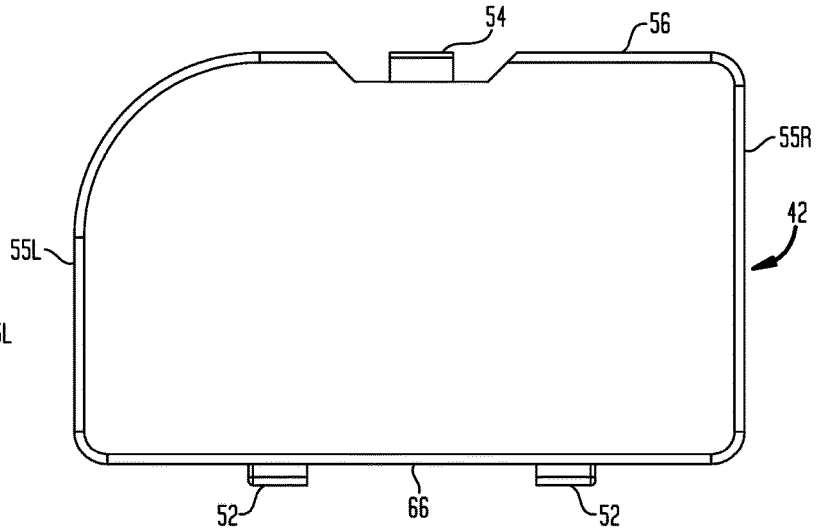
Figure 42:
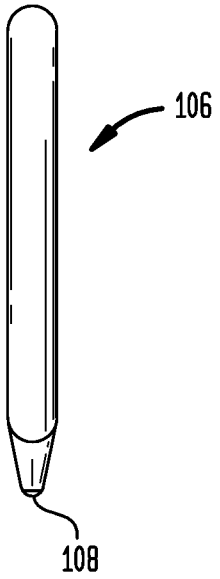
FIG. 42 is a schematic illustration of a rolling ball marker used for dispensing launderable or indelible ink.

In FIGS. 1-3, combination dispenser/carrying case/storage case 40 comprises base tray 42 joined to translucent lid 44 by hinges 46. Retaining latch 48 having central slot 50 (FIGS. 23, 25, 27) defined therein is joined to lid 44 by hinges 110, 112 (FIGS. 13, 15, 24, 26-27) and when pivoted into the closed position as shown in FIG. 1 mates with elongated stanchion 54 on front wall 56 of base 42. As shown in FIG. 8 as well as FIGS. 18 and 22, within base 42, labeling web core 58 is retained within the web storage compartment 60 separated from stencil compartment 62 by arcuate wall 64 extending between front wall 56 and wall 69 of base 42. Storage compartment 70 is adapted to hold retention frame 72 while storage compartment 68 is adapted to retain a marking medium applicator 106 as shown in FIG. 42, preferably a rolling ball type applicator capable of dispensing laundering resistant, more preferably indelible, ink such as that depicted at FIG. 42 as 106 having rolling ball 108 retained at one end thereof for dispensing of ink.

Figure 6:
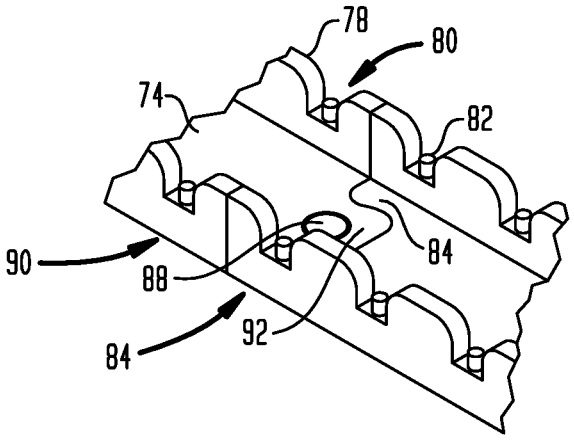
FIGS. 6 and 7 are schematic perspective views illustrating how combination labeling/stencil retention frames are joined to each other.
Figure 7:
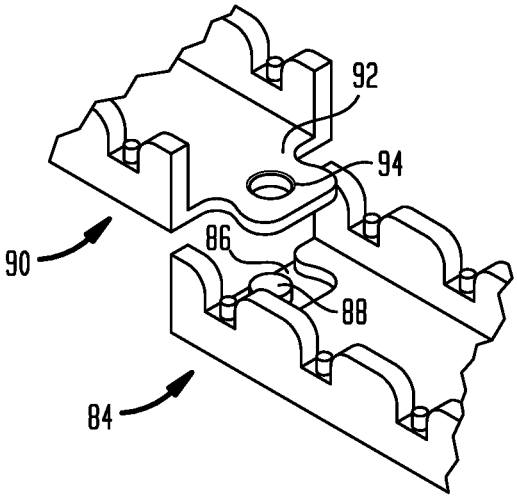

Combination labeling/retention frame 72 (FIGS. 2, 5, 28-32, 37-41), has planar central channel 74 defined therein bordered laterally by crenellated walls 76 having merlons 78 separated by crenels 80 having stanchions 82 disposed therein. Proximal end 84 of retention tray 72 has recess 86 with lug 88 projecting upwardly therein while distal end 90 of retention tray 72 has tongue 92 surrounding centrally located aperture 94 with tray tongue 92 and an centrally located aperture 94 being adapted to mate with recess 86 and lug 88 of similar retention tray 72 as shown in FIGS. 6 and 7.

Stencil elements 96 (FIGS. 3, 5, 33-38), have elongate projection tongues 98 with central apertures 100 defined therein with elongate projection tongues 98 and central apertures 100 therein being mateable with crenels 80 and stanchions 82.

Figure 4:
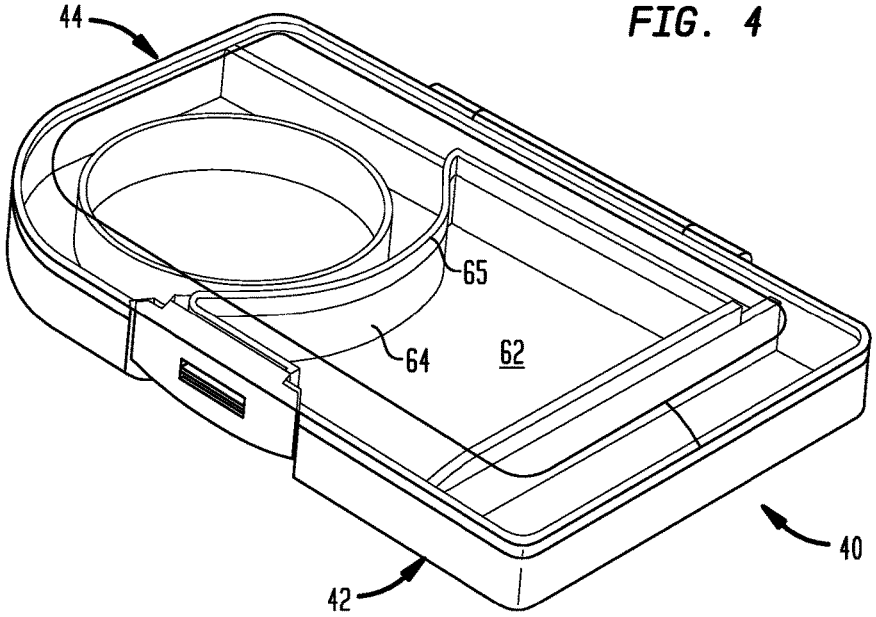
FIG. 4 is another perspective view of the combination dispenser/carrying case/storage case of FIG. 1.

In FIG. 4, another perspective view of combination dispenser/carrying case/storage case 40 is presented illustrating the juxtaposition of arcuate wall 64 defined in base tray 42 with arcuate ridge 65 defined in lid 44 whereby alphanumeric stencil elements 96 (not shown here) may be retained within letter compartment 62 (FIGS. 4, 8, 18, 22).

Figure 5:
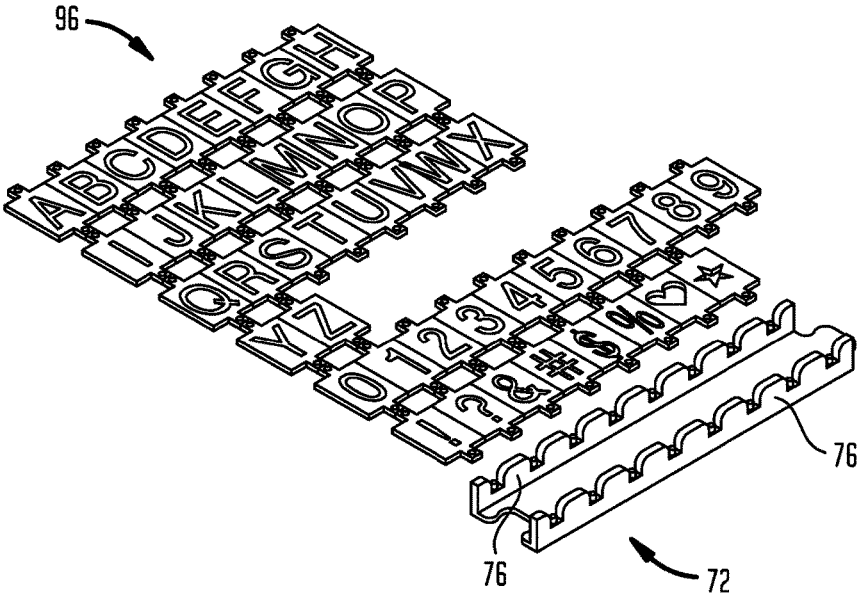
FIG. 5 is a perspective view which illustrates several representative alphanumeric stencil elements along with a combination labeling/stencil retention frame adapted to hold the representative alphanumeric stencil elements in place by means of the spaced mating retainers of the combination labeling/stencil retention frame of FIG. 2.
Figure 29:
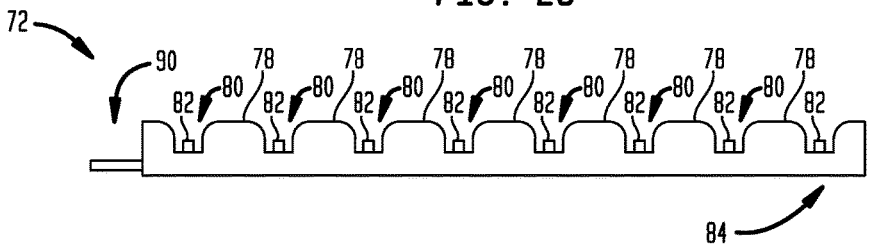
Figure 30:
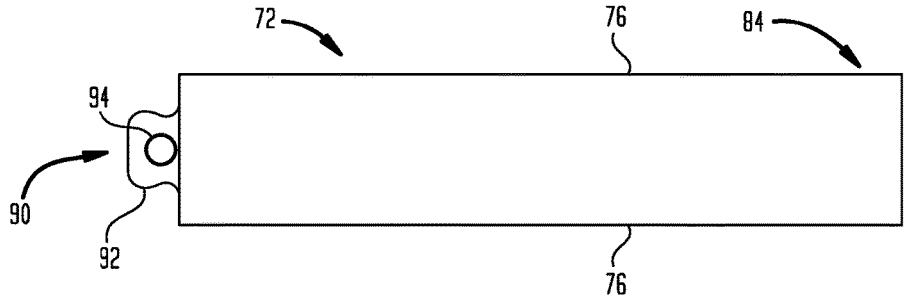
Figure 31:
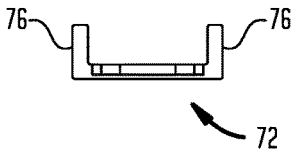
FIG. 31 is a side elevation thereof.
Figure 32:
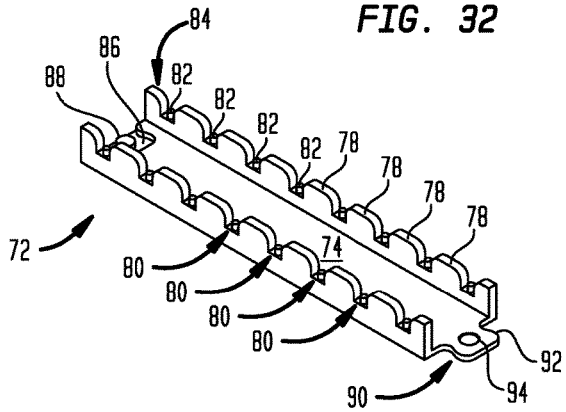
FIG. 32 is a perspective view of the retaining frame of FIG. 2.
Figure 33:
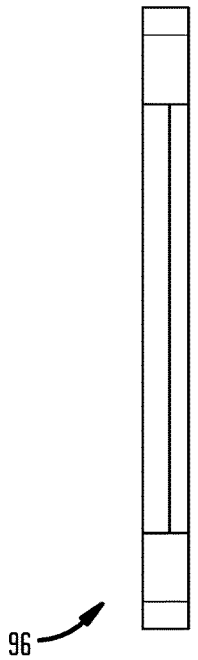
FIGS. 33 and 34 are, respectively, side and top views of an alphanumeric stencil element used in the practice of the present invention.
Figure 34:
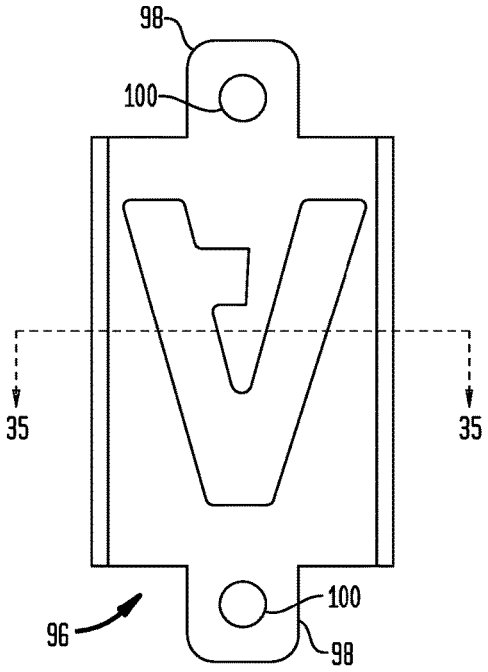
Figure 35:
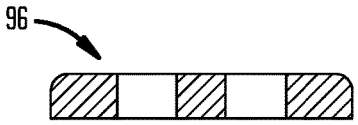
FIG. 35 is a sectional view taken along line 35-35 in FIG. 34.
Figure 36:
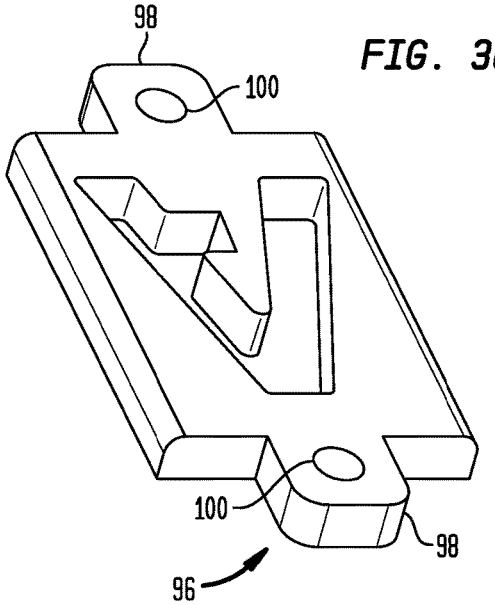
FIG. 36 is a perspective view of the alphanumeric stencil element of FIG. 34.

In FIG. 5, a plurality of alphanumeric stencil elements 96 are illustrated in isometric perspective along with an isometric perspective of retention frame 72 having crenellated sidewalls 76 (FIGS. 5, 29 and 32).

FIG. 6 illustrates interlocking of two stencil retention frames 72 along with details of retention stanchions 82 formed in crenels 80 between merlons 78.

FIG. 7 illustrates recess 86 with lug 88 projecting upwardly, mating with distal end 90 of similar retention tray 72 having tongue 92 surrounding centrally located aperture 94 with tray tongue 92 and an centrally located aperture 94 being adapted to mate with recess 86 and lug 88 of similar retention tray 72 as shown in FIG. 6.

FIG. 8 is an enlarged view of combination dispenser/carrying case/storage case 40 in which superposition of ridge 65 in lid 44 with walls 67 and 69 defines storage compartments 68 and 70.

Figure 9:
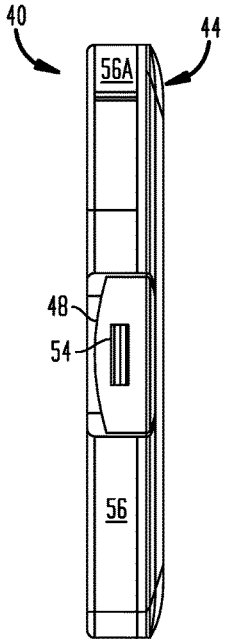
FIGS. 9 through 11 are front, plan and rear views of the combination dispenser/carrying case/storage case of FIG. 1.
Figure 10:
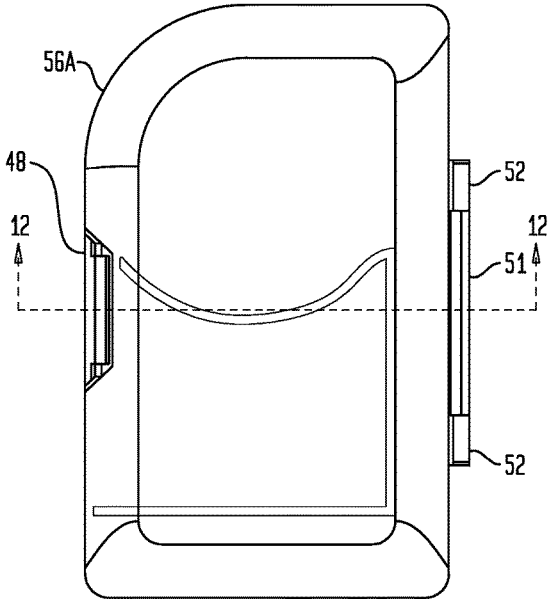
Figure 11:
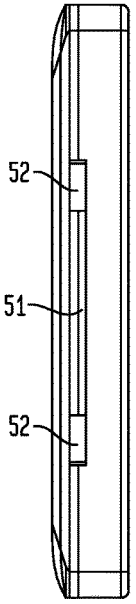
Figure 12:
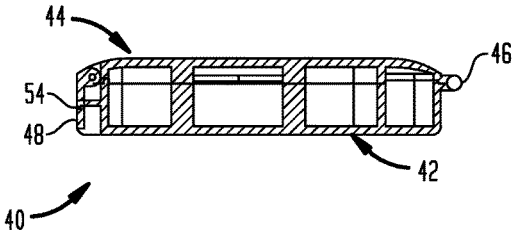
FIG. 12 is a sectional view of the combination dispenser/carrying case/storage case taken along line 12-12 in FIG. 10.
Figure 16:
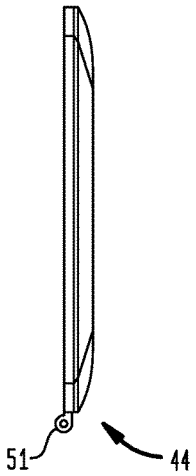
FIG. 16 is a side elevation thereof.
Figure 13:
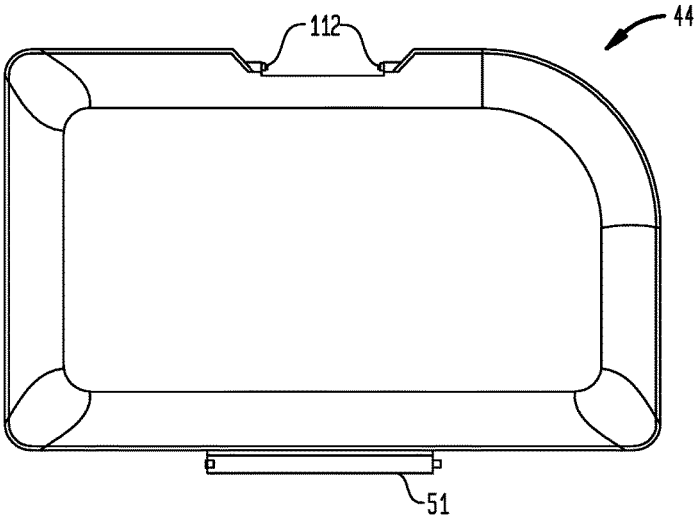
Figure 14:
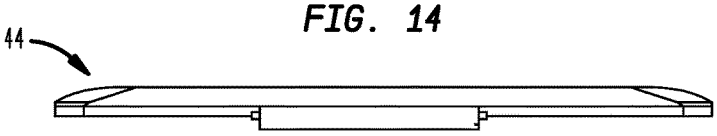
Figure 15:
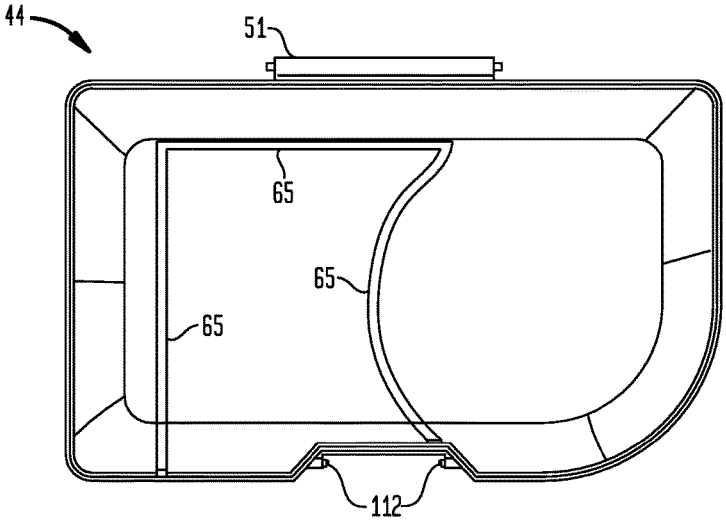

FIGS. 9, 10 and 11 illustrate front elevation, plan view and rear elevation of combination dispenser/carrying case/storage case 40 while FIG. 12 is a sectional view taken along line 12-12 of FIG. 10.

FIGS. 13, 14, 15 and 16 illustrate respectively top view, rear view, bottom view and left elevation of translucent lid 44 having ridge 65 defined therein. Latch hinge pins 112 mate with latch hinge receptacle 110 in FIGS. 24, 26 and 27 allowing central slot 50 of retaining latch 48 be superposed over and interpenetrate elongated stanchion 54, firmly sealing translucent lid 44 into place over base/tray 42.

Figure 17:
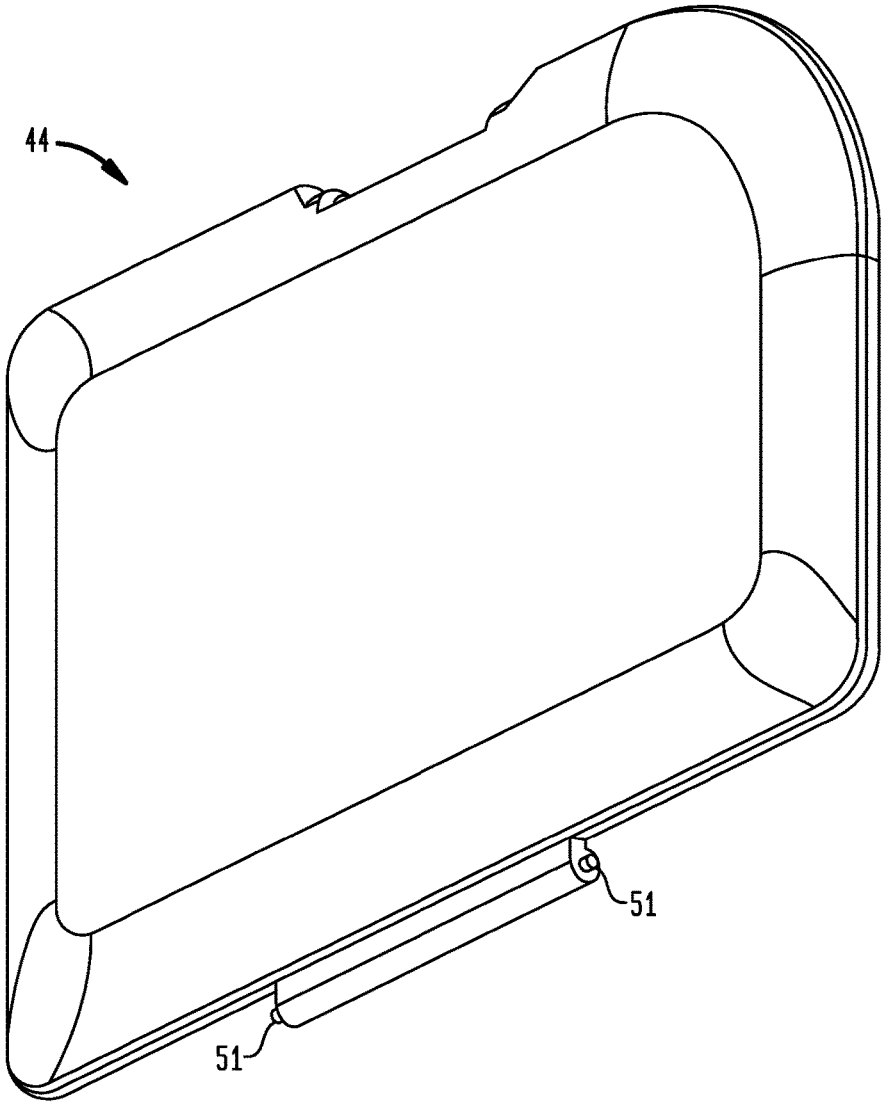
FIG. 17 is an enlarged perspective view of the lid of the combination dispenser/carrying case/storage case of FIG. 1.

FIG. 17 is an isometric perspective of translucent lid 44. Male hinge element 51 on lid 44 which mates with female hinge elements 52 on base tray 42 is depicted.

Figure 22:
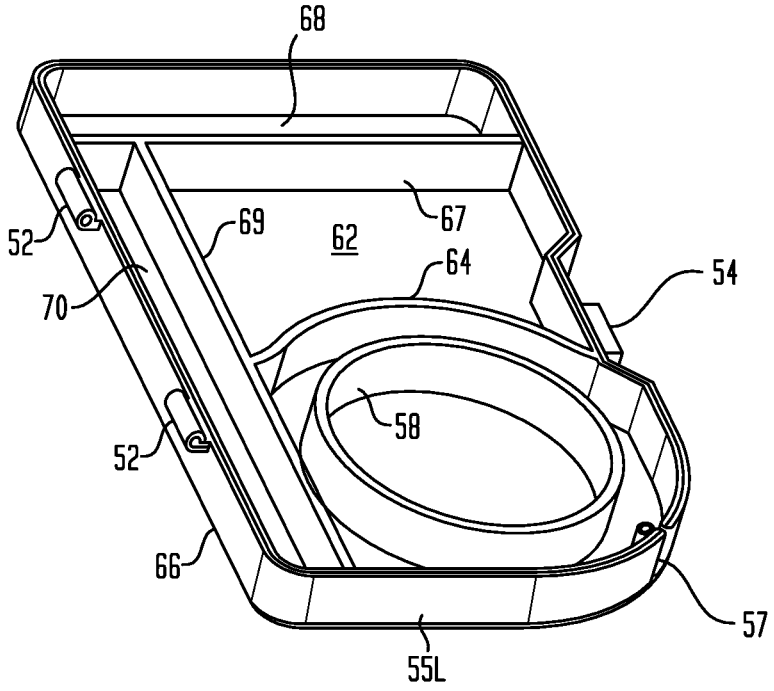
FIG. 22 is a perspective view of the base tray of the combination dispenser/carrying case/storage case of FIG. 1.

FIGS. 18, 19, 20 and 21 are respectively plan, rear elevation, bottom and left elevation views of base tray 42, illustrating aperture 57 in peripheral wall 55 whereby web 102 passes from web storage compartment 60 to the exterior of combination dispenser/carrying case/storage case 40. Core 58 upon which web 102 is wound is seen disposed within the web storage compartment 60. FIG. 22 is an isometric perspective of base tray 42. Peripheral wall 55 of base tray 42 comprises front wall 56 rear wall 66, arcuate peripheral section 56A as well as right wall 55R and left wall 551. Web storage compartment 60 is defined between arcuate wall 64 and arcuate peripheral section 56A, while storage compartment 68 is separated from letter compartment 62 by wall 67 while storage compartment 70 is defined between rear wall 66 and wall 69. In FIGS. 18, 19, 20, 21 and 22, female hinge elements 52 are visible on base/tray 42. As mentioned, female hinge elements 52 mate with male hinge element 51 on lid 44.

Figure 23:
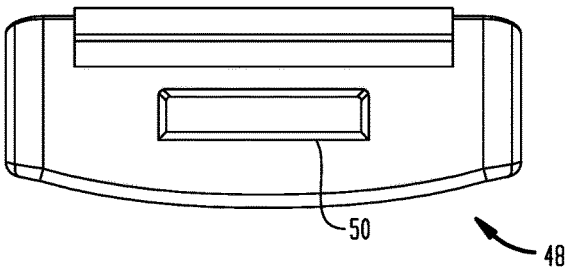
Figure 26:
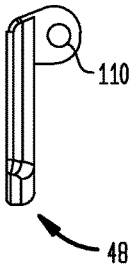
FIG. 26 is a side elevation thereof.
Figure 24:
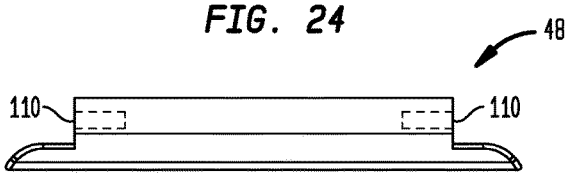
Figure 25:
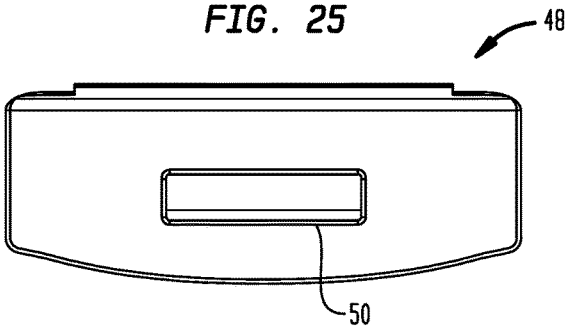
Figure 27:
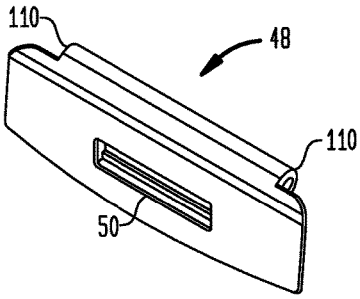
FIG. 27 is a perspective view of the latch of the combination dispenser/carrying case/storage case of FIG. 1.
Figure 28:
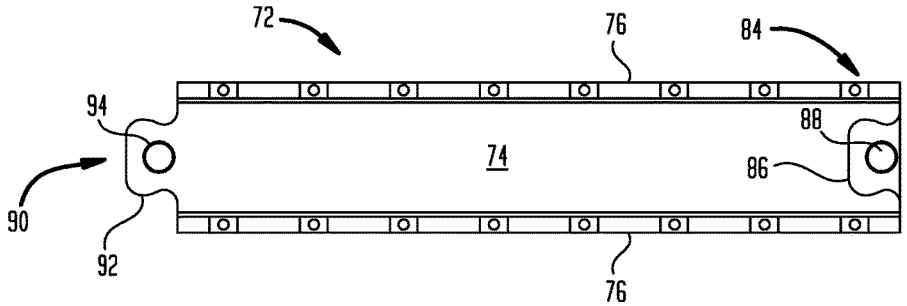

FIGS. 23, 24 and 25 are respectively rear elevation, top view and front elevation of retaining latch 48 while FIG. 26 is a right elevation of retaining latch 48 and FIG. 27 is an isometric perspective thereof. Central slot 50 is penetrated by elongated stanchion 54 disposed on front wall 56 of base 42 in order to latch translucent lid 44 in the closed position.

FIGS. 28, 29, 30, 31 and 32 illustrate retention frames 72 having crenels 80 defined between merlons 78 with stanchions 82 defined in crenels 80 while planar central channel 74 is adapted to receive web 102 (FIGS. 37-38) and each respective retention frame 72 has projecting longitudinally from distal end 90 of retention frame 72 tray tongue 92 with centrally located aperture 94 defined therein, while proximal end 84 of retention frame 72 has recess 86 with lug 88 projecting upwardly therein. Conveniently, several retention frames 72 may be joined by disposing centrally located aperture 94 over lug 88 in an adjacent frame 72. Advantageously, even with names or other identifying indicia of considerable length, it is possible to form elongated stencils by superimposing frame aperture 94 over lug 88 on several joined frames 72 and subsequently to store individual frame sections 72 having alphanumeric stencil elements 96 in place inside tray 42 by separating frame sections 72 from each other while leaving stencil elements 96 in place on each respective frame 72.

FIGS. 33, 34, 35 and 36 illustrate an alphanumeric stencil element 96 having elongate stencil projection tongues 98 having central stencil apertures 100 defined therein. Central stencil apertures 100 on stencil elements 96 are adapted to mate with stanchions 82 disposed in crenels 80 of crenellated sidewalls 76 of retention frame 72 so that alphanumeric stencil elements 96 may be fixed in place easily to guide movement of marker 106 as it deposits indelible ink on web 102.

Figure 37:
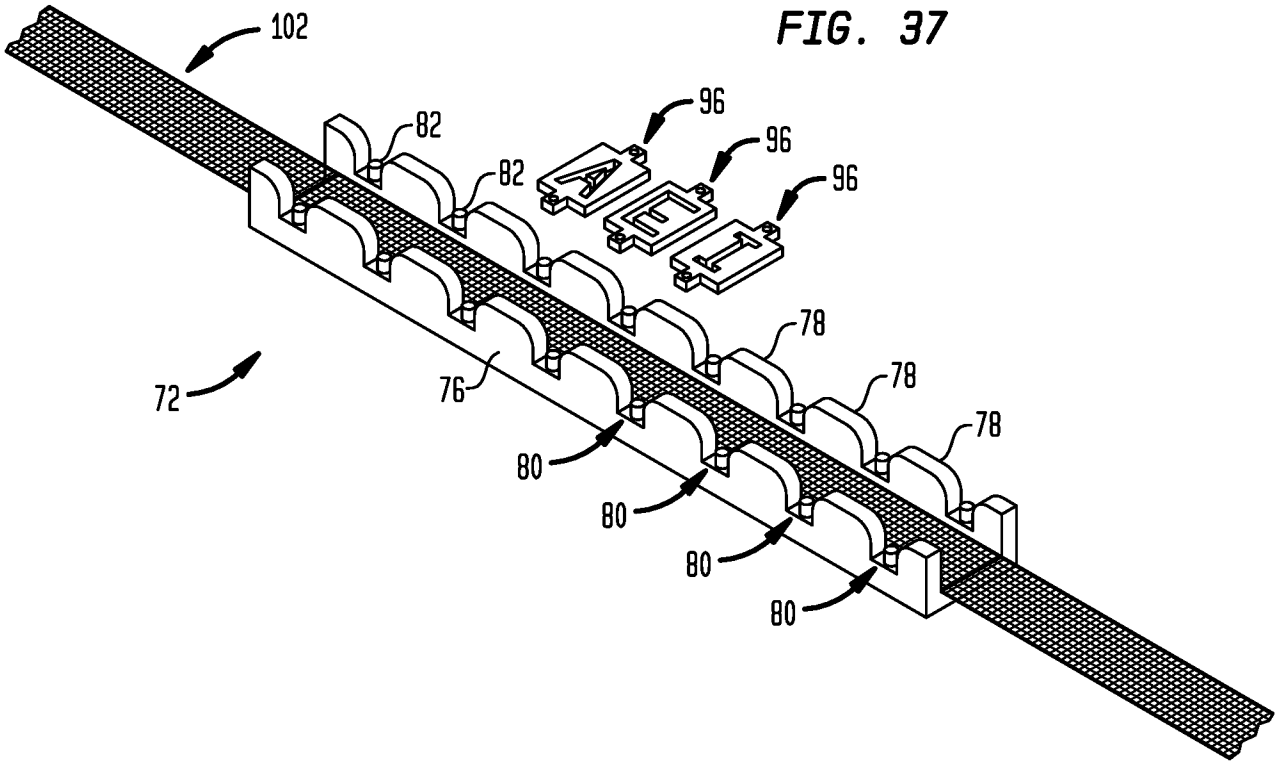
FIG. 37 is a perspective view of the frame of FIG. 32, with alphanumeric stencil elements of FIG. 5 adjacent and with a web of labeling material retained therein.

FIG. 37 illustrates web 102 deployed within planar central channel 74 defined by crenellated walls 76 with alphanumeric stencil elements 96 ready to be urged into position to guide marking of web 102.

Figure 38:
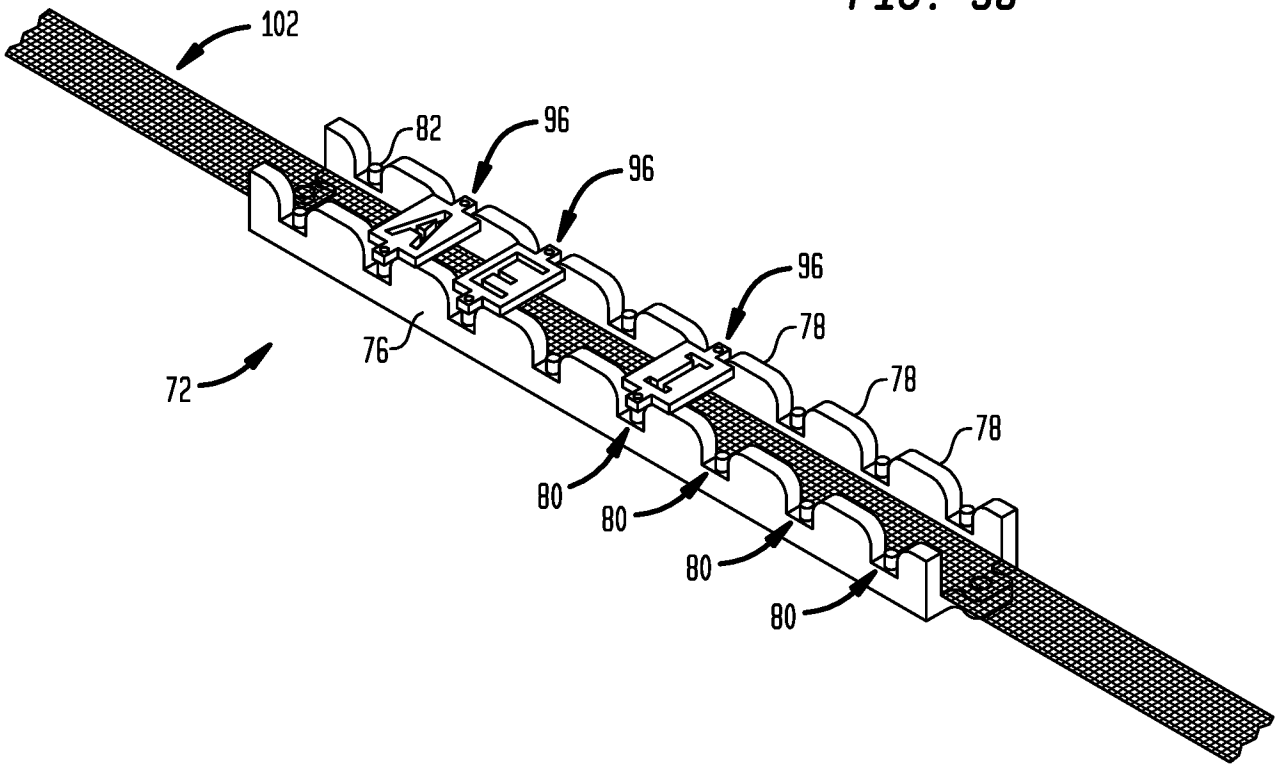
FIG. 38 is a perspective view of the frame of FIG. 32, with a web of labeling material retained therein and with the alphanumeric stencil elements of FIG. 5 being moved into position for marking of the web of labeling material retained therein.

In FIG. 38, stencil elements 96 are being urged into position in frame 72.

Figure 39:
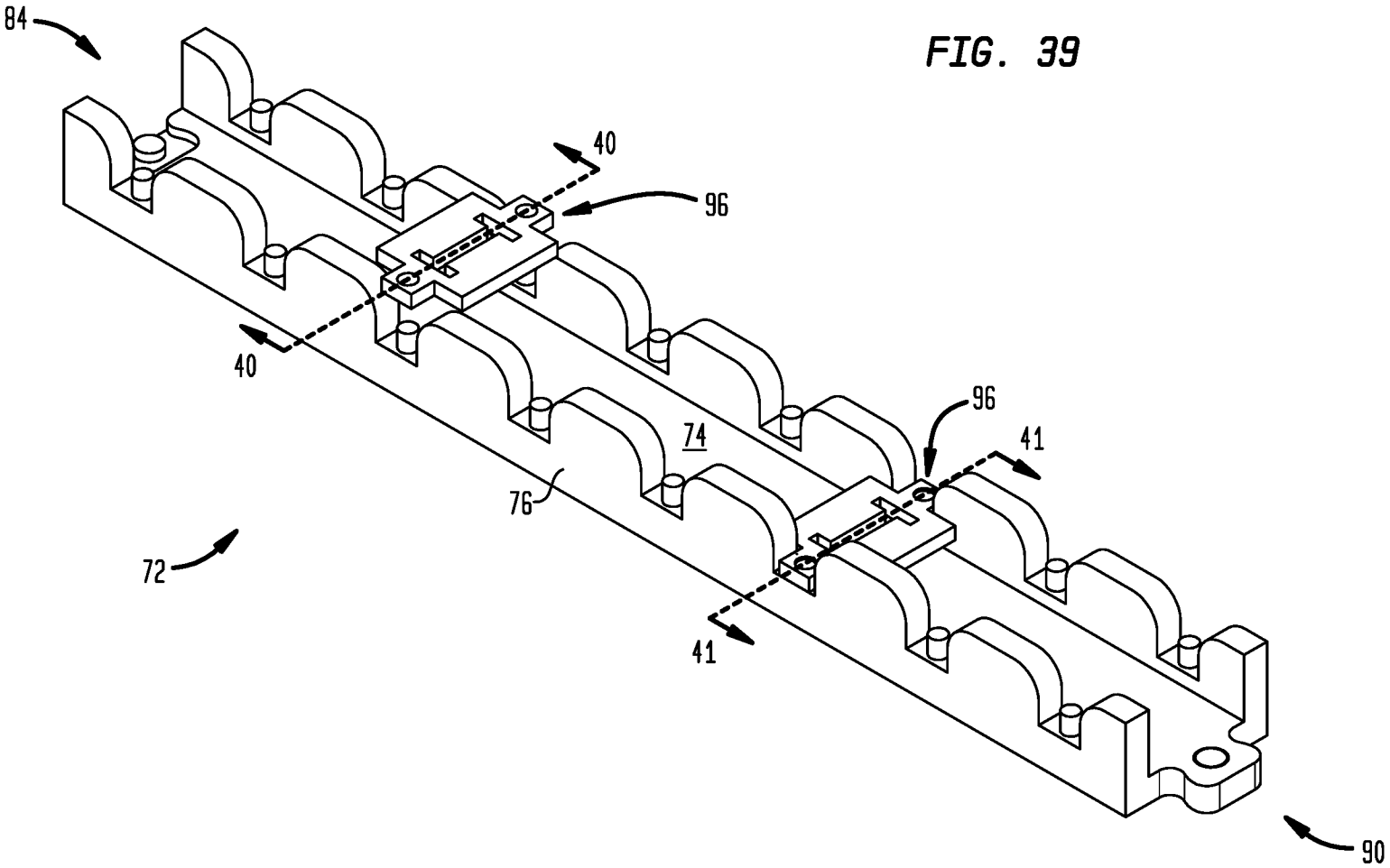
FIG. 39 is an isometric perspective view of the frame of FIG. 32, with the alphanumeric stencil elements of FIG. 5 being moved into position, bearing markings to indicate line 40-40 and line 41-41 along which sectional views for FIGS. 40 and 41, respectively, are taken.
Figure 40:
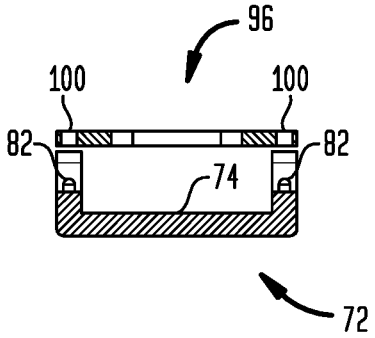
FIGS. 40 and 41 are sectional views of a stencil element as it is moved into position in the frame.
Figure 41:
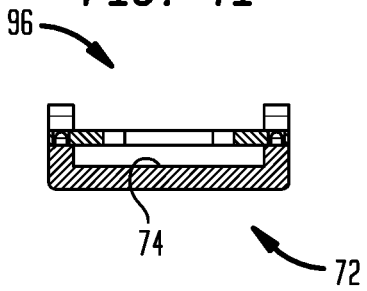

FIG. 39 is an isometric perspective of a tray 72 with an alphanumeric stencil element 96 ready to be urged into position, marked to indicate where section line 40-40 has been taken in FIG. 40, and with an alphanumeric stencil element 96 fixed in place, marked to indicate where section line 41-41 has been taken in FIG. 41. FIG. 40 illustrates a sectional view of FIG. 39 taken along lines 40-40 showing stencil element 96 positioned with stencil apertures 100 above stanchions 82 on tray 72 while FIG. 41 illustrates stencil element 96 with stanchions 82 interpenetrating apertures 100. In FIG. 41 it can be observed that there is sufficient clearance between stencil element 96 and central planar region 74 for introduction and passage of web 102 even when stencil element 96 is already in position. FIG. 42 depicts a rolling ball marker 106 having rolling ball 108 through which launderable, preferably indelible, ink may be dispensed.

While the invention has been described in detail, modifications within the spirit and scope of the invention will be readily apparent to those of skill in the art. In view of the foregoing discussion and relevant knowledge in the art, further description is deemed unnecessary. In addition, it should be understood that aspects of the invention and portions of various embodiments may be combined or interchanged either in whole or in part. Furthermore, those of ordinary skill in the art will appreciate that the foregoing description is by way of example only, and is not intended to limit the invention.

As my invention, I claim:

1. A kit for creating stencils, comprising:

A. a polymeric shell comprising a tray and a sealing top movably attached to said tray;
  said tray being generally rectangular with a peripheral sidewall and having a plurality of compartments defined therein including at least:
    a roll storage compartment having an opening defined through said peripheral sidewall;
    an alphanumeric stencil element storage compartment;
    a frame holder compartment; and
    a marker holding compartment;

B. a linear polymeric frame comprised of a styrenic polymer having:
  an elongate central planar portion;
  a pair of parallel upraised sidewalls spaced on either side of said elongate central planar portion;
  a plurality of stencil retention elements defined in each said sidewall, spaced along the length thereof;

C. a plurality of polymeric alphanumeric stencil elements comprised of an injection moldable thermoplastic rubber polymer adapted to fit between said upraised sidewalls and mate with said stencil retention elements defined therein;

D. a marker; and

E. a roll of markable web having an adhesive backing adapted to be retained within said roll storage compartment, the width of said web being adapted to pass through said opening defined through said peripheral sidewall of said roll storage compartment, and adapted to longitudinally pass between said upraised sidewalls of said linear frame yet be laterally restrained thereby.

2. The kit for creating stencils of claim 1, wherein a portion of the peripheral sidewall adjacent said roll storage compartment and having said opening therethrough is generally arcuate having a radius of curvature of at least 33% of the width of said tray.

3. The kit for creating stencils of claim 2, wherein said tray is comprised of acrylonitrile butadiene styrene; said sealing top is hingedly joined to said tray and is chosen from the group consisting of transparent and translucent polymers.

4. The kit for creating stencils of claim 3, wherein said markable web is comprised of a textile material and said adhesive backing is an iron-on adhesive.

5. The kit for creating stencils of claim 4, wherein said marker is a rolling ball marker dispensing an ink resistant to laundering.

6. The kit for creating stencils of claim 5, wherein said linear polymeric frame is comprised of an acrylonitrile butadiene styrene polymer and has a plurality of posts defined along the length thereof and said alphanumeric stencil elements each comprise projections extending from each end thereof having an aperture defined therein adapted to mate with said posts.

7. The kit for creating stencils of claim 5, wherein said alphanumeric stencil elements comprise a thermoplastic rubber polymer, each element comprising projections extending from each end thereof, each projection having a post extending therefrom and said linear polymeric frame is comprised of an acrylonitrile butadiene styrene polymer and has a plurality of apertures defined along the length adapted to mate with said posts.

8. A kit for creating stencils, comprising:

A. a polymeric shell comprising a tray and a sealing top; said tray being generally rectangular with a peripheral sidewall and having a plurality of compartments defined therein, wherein said tray is comprised of acrylonitrile butadiene styrene; said sealing top is hingedly joined to said tray and is chosen from the group consisting of transparent and translucent polymers; and wherein said tray includes at least a roll storage compartment having an opening defined through said peripheral sidewall; wherein a portion of the peripheral sidewall adjacent said roll storage compartment and having said opening therethrough is generally arcuate having a radius of curvature of at least 33% of the width of said tray;

an alphanumeric stencil element storage compartment;

a frame holder compartment; and a marker holding compartment

B. a linear polymeric frame comprised of an acrylonitrile butadiene styrene polymer having:

an elongate central planar portion;

a pair of parallel upraised sidewalls spaced on either side of said elongate central planar portion;

a plurality of stencil retention elements defined in each said sidewall, spaced along the length thereof;

C. a plurality of thermoplastic rubber polymeric alphanumeric stencil elements comprised of an injection moldable thermoplastic rubber polymer adapted to fit between said upraised sidewalls and mate with said stencil retention elements defined therein;

D. a rolling ball marker dispensing an ink resistant to laundering;

E. a roll of markable web having an adhesive backing adapted to be retained within said roll storage compartment, wherein said markable web is comprised of a textile material and said adhesive backing is an iron-on adhesive, the width of said web being adapted to pass through said opening defined through said peripheral sidewall of said roll storage compartment, and adapted to longitudinally pass between said upraised sidewalls of said linear frame yet be laterally restrained thereby.

9. The kit for creating stencils of claim 8, wherein said linear polymeric frame has a plurality of posts defined along the length thereof and said alphanumeric stencil elements each comprise projections extending from each end thereof having an aperture defined therein adapted to mate with said posts.

10. The kit for creating stencils of claim 8, wherein said alphanumeric stencil elements each comprise projections extending from each end thereof, each projection having a post extending therefrom, and said linear polymeric frame has a plurality of apertures defined along the length adapted to mate with said posts.

11. A kit for creating stencils, comprising:

A. a polymeric shell comprising a tray and a sealing top movably attached to said tray;

said tray being generally rectangular with a peripheral sidewall and having a plurality of compartments defined therein, wherein said tray is comprised of acrylonitrile butadiene styrene; said sealing top is hingedly joined to said tray and is chosen from the group consisting of transparent and translucent polymers; and wherein said tray includes at least a roll storage compartment having an opening defined through said peripheral sidewall; wherein a portion of the peripheral sidewall adjacent said roll storage compartment and having said opening therethrough is generally arcuate having a radius of curvature of at least 33% of the width of said tray;

an alphanumeric stencil element storage compartment;

a frame holder compartment; and a marker holding compartment;

B. a plurality of linear polymeric frames comprised of an acrylonitrile butadiene styrene polymer, each having:

an elongate central planar portion;

a pair of parallel upraised crenellated sidewalls spaced on either side of said elongate central planar portion, said crenellated sidewall comprising a series of interspersed crenels and merlons;

a plurality of stencil retention elements defined in crenels in each said sidewall, spaced along the length thereof;

mateable elements being defined at each end of each frame making it possible to join frames together seriatim to spell out longer names or more involved indicia of identification;

C. a plurality of thermoplastic rubber polymeric alphanumeric stencil elements comprised of an injection moldable thermoplastic rubber polymer adapted to fit between said upraised sidewalls and having elongate projections having stencil retention elements adapted to mate with said stencil retention elements defined in said crenels, wherein said stencil retention elements comprise a plurality of posts defined in one of said crenels and said elongate projections and a plurality of mateable apertures defined in the other of said crenels and said elongate projections, wherein when said stencil elements mate with said posts, the lower surfaces of said stencil elements are spaced above said elongate central portion of said frame, such that markable web may be passed thereunder;

D. a rolling ball marker dispensing an ink resistant to laundering; and

E. a roll of markable web having an adhesive backing adapted to be retained within said roll storage compartment, wherein said markable web is comprised of a textile material and said adhesive backing is an iron-on adhesive, the width of said web being adapted to pass through said opening defined through said peripheral sidewall of said roll storage compartment, and adapted to longitudinally pass between said upraised sidewalls of said linear frame yet be laterally restrained thereby.

* * * * *